US006450339B1

(12) United States Patent
Ashton

(10) Patent No.: US 6,450,339 B1
(45) Date of Patent: Sep. 17, 2002

(54) HOLIDAY LIGHT STRAND ORGANIZER

(76) Inventor: Douglas W. Ashton, 3917 N. Point Blvd., Dundalk, MD (US) 21222

( * ) Notice: Subject to any disclaimer, the term of this patent is extended or adjusted under 35 U.S.C. 154(b) by 15 days.

(21) Appl. No.: 09/680,076

(22) Filed: Oct. 5, 2000

Related U.S. Application Data

(60) Provisional application No. 60/157,600, filed on Oct. 5, 1999.

(51) Int. Cl.[7] ..... B65D 85/42

(52) U.S. Cl. ..... 206/419; 206/420; 206/388; 211/13

(58) Field of Search ..... 206/388, 419, 206/420, 702; 211/13

(56) References Cited

U.S. PATENT DOCUMENTS 5,033,619 A * 7/1991 Garis ..... 206/419
5,064,067 A * 11/1991 McAllister et al. ..... 206/420
5,139,208 A * 8/1992 Schooley ..... 211/13
5,287,965 A * 2/1994 Miller ..... 206/396
5,317,491 A * 5/1994 Lee ..... 206/420
5,381,899 A * 1/1995 Rabbitt ..... 206/397
5,653,339 A * 8/1997 Dobson ..... 206/420
5,661,953 A * 9/1997 Jolley ..... 53/430
5,941,388 A * 8/1999 Spielberger ..... 206/419
6,142,405 A * 11/2000 Black ..... 242/388.6

* cited by examiner

*Primary Examiner*—David T. Fidei
(74) *Attorney, Agent, or Firm*—Law Offices of Royal W. Craig

(57) ABSTRACT

A holiday light strand organizer that is amenable to the winding and storage of holiday light strands, extension cords, and like articles, after such are first used, in the configuration of a drawer unit comprising a carrier portion having a frame structure about which the article is wound, and a storage case portion in which the carrier portion is inserted for storage. A frame with a wide cross section is provided, so that conducting strands are not excessively flexed or creased when wound for storage. A holder for the plug or socket portion of a holiday light strand or like article is a separate position from the strand, so that the ends of the strand do not become tangled and may be easily located for the testing of the strand. The carrier has special provision in the form of a clip to accept the plug or socket portion of the holiday light strand so that it does not become tangled, and can be found for testing of the light strand. When the holiday light strand or like article is to be used, the carrier portion is removed leaving the storage case portion in place. The carrier portion is taken to where the stored articles are to be used.

12 Claims, 4 Drawing Sheets

HOLIDAY LIGHT STRAND ORGANIZER

CROSS-REFERENCE TO RELATED APPLICATIONS

The present application derives priority from U.S. Provisional Patent Application 60/157,600 for "HOLIDAY LIGHT STRAND ORGANIZER"; Filed: Oct. 5, 1999, Applicant: Douglas Ashton.

BACKGROUND OF THE INVENTION

1. Field of the Invention

This invention relates to holiday light storage devices and, in particular, to a holiday light strand organizer that includes slidable storage frames in the configuration of a drawer unit that receives stands or cords of holiday lights or like articles.

2. Description of the Background

Holiday lights of the type referenced herein include a number of small lamps each mounted in a lamp socket and placed at roughly equal intervals along an electrical connection comprising two or more insulated conductors. The connection both provides power to the lamps and supports the strand of lights when it is mounted on a tree, or a structure, or so forth. Such strands of holiday lights are sold in a holder or packaging system of the type described in U.S. Pat. No. 5,458,824 to Brown.

These packaging holders are well suited for shipping and storage of new holiday light strands, but are not adequate for the storage and organizing of strands that have already been unpacked for use. It is extremely difficult to restore the holiday light strand to the condition it was in when separated from the packaging holder. The holiday light strand packaging in general is designed for the distribution of the product for least cost. It is therefore desirable to provide a product for the efficient storage of holiday light strands after their first use, in an economical and facile manner.

Furthermore, there is a growing interest in older holiday light strands, which are valuable and fragile antiques in some cases. Their bulbs, bases, and electrical connection require greater protection and care than modern light strands.

Specialized means for the storage of holiday lights are present in the prior art. By way of example, U.S. Pat. No. 5,907,945 to Doyle discloses a base upon which a pair of trays hold the light base portions of a holiday light strand. This apparatus appears to perform the function of the present invention, but with several drawbacks. It is unsuitable for older light sets or light sets of other than a standard, modern design. It is unsuitable for extension cords or like articles, and appears to have no provision for the holding of a plug or socket in a special position. It relies on a precise spacing of the bulbs in a holiday light set, and it may if used cause undue stress on the attachments between the conductors and the light bases on a light strand.

By way of further example, U.S. Pat. No. 5,653,339 to Dobson discloses a storage receptacle into which a plurality of cordage members are provided for strands of holiday lights. The resultant unit is large and heavy, which makes it inconvenient for holiday storage. Moreover, the cordage members that perform the function of frames have no provision for the holding of a plug or socket in a special position. Cords wrapped around the member can crease because the member has a narrow cross section.

It would be greatly advantageous to provide a holiday light strand organizer that is in the configuration of a slim-line drawer unit for convenience, said drawer units being closable to protect holiday light strands or like articles from light, dirt, moisture, and so forth, and said drawer units being modular and stackable for convenient storage.

SUMMARY OF THE INVENTION

It is therefore an object of the present invention to provide a holiday light strand organizer that facilitates the winding and storage of holiday light strands, extension cords, and like articles, after such are first used.

It is a further object of the present invention to provide means of storing holiday light strands, extension cords, and like articles on a frame with a wide cross section, so that conducting strands are not excessively flexed or creased when wound for storage.

It is a further object of the present invention to provide a holder for the plug or socket portion of a holiday light strand or like article is a separate position from the strand, so that the ends of the strand do not become tangled and may be easily located for the testing of the strand.

It is a further object of the present invention to provide a holiday light strand organizer that is in the configuration of a drawer unit for convenience, which drawer units are modular and may be stacked and labeled, and which drawer units may be pulled out for convenient carrying.

It is a further object of the present invention to provide a holiday light strand organizer that is in the configuration of a drawer unit so that when closed the holiday light strands or like articles are protected from light, dirt, moisture, and so forth.

These and other objects are accomplished by the provision of a holiday light storage organizer in the configuration of a drawer unit comprising a carrier portion having a frame structure about which the article is wound, and a storage case portion in which the carrier portion is inserted for storage. The carrier has special provision in the form of a clip to accept the plug or socket portion of the holiday light strand so that it does not become tangled, and can be found for testing of the light strand. When the holiday light strand or like article is to be used, the carrier portion is removed leaving the storage case portion in place. The carrier portion is taken to where the stored articles are to be used.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
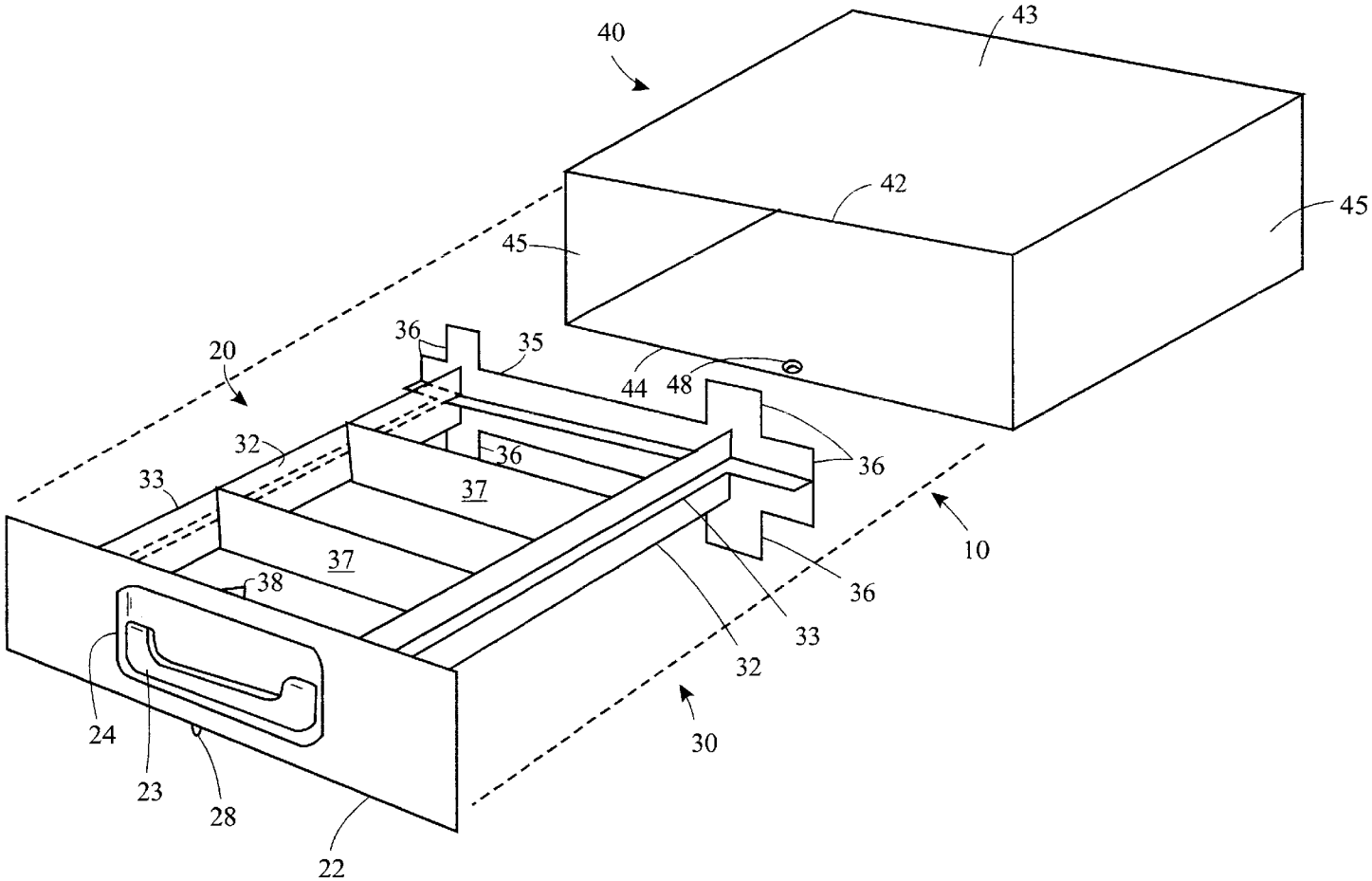
FIG. 1 is an isometric view drawing of a holiday light strand organizer 10 according to a preferred embodiment of the present invention.

FIG. 1 is an isometric view drawing of a holiday light strand organizer 10 according to a preferred embodiment of the present invention. The holiday light strand organizer 10 generally comprises a carrier portion 20 including frame 30, and an independent storage case 40.

The carrier portion 20 includes a front panel 22 formed with a central recess 24, and a pivoting handle 23 set flush into recess 24. For this purpose, the pivoting handle 23 is preferably equipped with lateral pins at each end that insert into holes formed in the side walls of the recess 24. This particular handle 23-in-recess 24 configuration provides a flat aspect to the face 22 of the organizer 10 so that the organizer is conveniently stacked with other objects such as boxes. However, it should be readily apparent to one of ordinary skill in the art that other suitable means for grasping and holding the carrier portion 20 may be used. Carrier portion 20 further comprises a distinctive reinforced frame 30 around which a holiday light strand or like article may be wound.

Further referring to FIG. 1, storage case portion 40 is in the form of a slim-line rectangular walled enclosure having an aperture 42 at one end for receiving and seating the carrier portion 20. This slim-profile configuration allows a plurality of such organizers 10 to be conveniently stacked for compact storage. Carrier portion 20 conforms to the inner dimensions of aperture 42 and slides therein until panel 22 is seated in aperture 42, the case portion 40 thereby substantially concealing and storing the carrier portion 20 and its cargo. Bottom face 44 incorporates a small hole 48 central to and adjacent case aperture 42 for the purpose of engaging a resilient tab 28 formed on and protruding downwardly from the front panel 22 of carrier portion 20. The hole 27 and tab 28 serve to index the drawer and lock carrier portion 20 in place in a fully inserted position. It should be apparent to one of ordinary skill in the art that alternate conventional means of interlocking may be used for this purpose.

Optional indexing ribs or conforming tracks may be provided on the side walls 45 or top and bottom walls 43, 44 of storage case portion 40 to help in stacking organizers. By way of further example, adjacent organizers may incorporate interlocking means on side faces 45.

Figure 2:
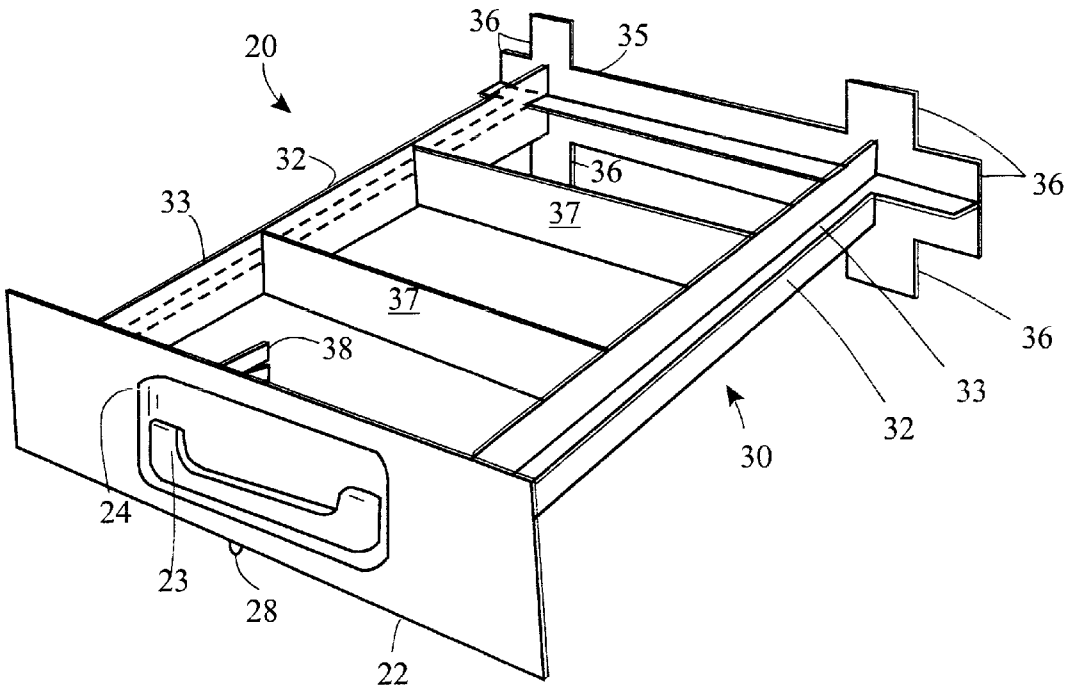
FIG. 2 is an enlarged isometric view of the carrier portion 20 of the holiday light strand organizer 10 of FIG. 1.

FIG. 2 is an enlarged isometric view of the carrier portion 20 of the holiday light strand organizer 10 of FIG. 1. As seen in FIG. 2, the carrier portion 20 of the holiday light storage organizer is configured to be conveniently carried by the user from the place the lights are stored to the place where the lights are to be deployed. Carrier frame 30 generally comprises a pair of vertical frame members 32 each reinforced by an orthogonal rib 33. The rib strengthens the members 32 and also serves to present a further point of contact for a holiday light strand or like article. Prior art storage articles require the light strand to be wound around a single contact, which causes excessive flexing and creasing of the strand. Presenting three points of contact on each member greatly reduces this condition.

Rear member 35 of frame portion 30 is configured to rest against the rear face of drawer portion 40 when carrier portion 20 is slidably inserted. A plurality of flanges 36 radiating out from the rear member 35 engage the inside faces of the drawer portion 40 as the carrier portion 20 is slidably inserted, support the frame portion 30 when stored, and prevent the contents from sliding downward when carried. One or more cross-braces 37 further act as struts to strengthen the structure and provide resistance to the stress caused by winding a strand between frame members 32. A clip 38 is provided on the interior surface of face portion 22 for the purpose of engaging either the plug or socket portion of a strand, or the cord in vicinity of such portion. A resilient tab 28 positioned along the edge of face portion 22 coincident with recess 48 of drawer portion 40 engages said recess 48 to hold the carrier portion 20 fully inserted in the drawer portion 40.

Figure 3:
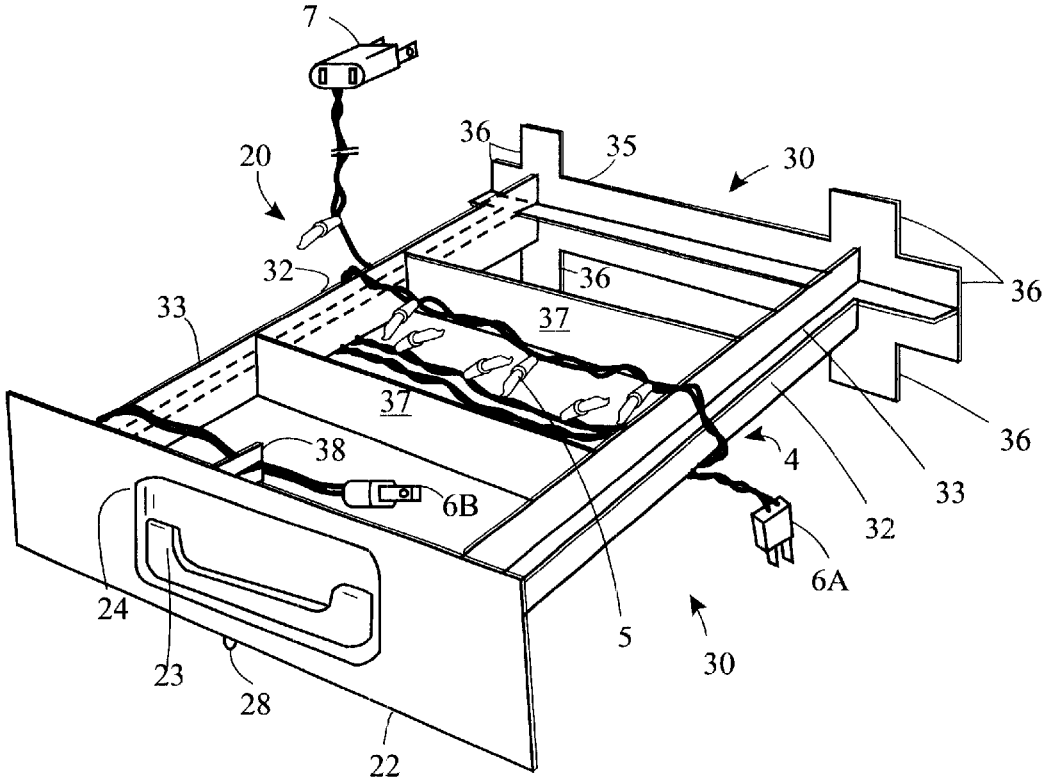
FIG. 3 is an isometric view drawing of the carrier portion 20 of FIG. 1 showing the application of a holiday light strand 4.

FIG. 3 shows the carrier portion 20 of the present holiday light storage organizer 10 with an exemplary holiday light strand 4 applied. The strand 4 comprises a number of lamps 5 attached at roughly equal intervals to an electrical connection which may terminate at one or both ends with a standard plug 6 or a modular plug and socket 7, which are configured to accept standard house current. One or more strands 4 are wound continuously between frame members 32 and over ribs 33 until they are almost completely wound. Plug portion 6 or socket portion 7 are placed in clip 38 so that end portions of the strand 4 are not tangled and the plug portion 6 or socket portion 7 can be found for testing. Here, plug portion in position 6A is shown attached to strand 4, and placed between the prongs of clip 38 in position 6B. In this configuration, the holiday light strand may be tested by applying electrical current to the strand 4 without unwinding the strand 4 from the frame 30. It is readily apparent to one of ordinary skill in the present art that an extension cord, of a commercially available type commonly used in holiday light applications, can be stored and carried on the same carrier portion 20 as a holiday light strand.

Figure 4:
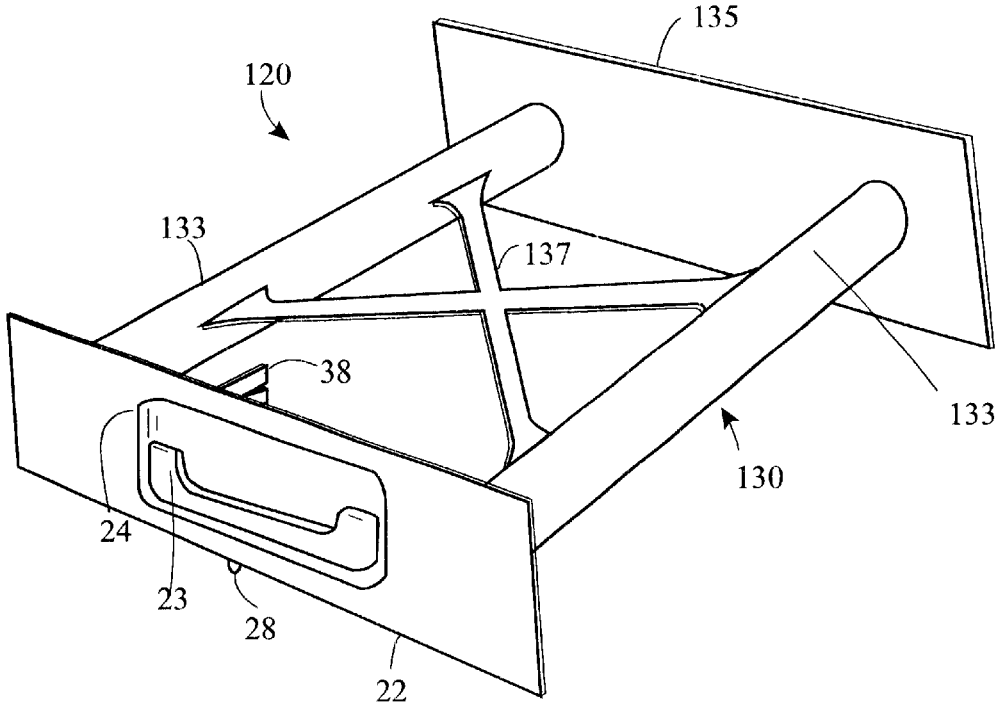
FIG. 4 is an isometric view drawing of a carrier portion 120 of the holiday light strand organizer 10, according to a second embodiment of the present invention.

FIG. 4 is an isometric view of the carrier portion 120 of the holiday light strand organizer according to a second embodiment of the present invention. As seen in FIG. 4, in this carrier portion 120 the frame members and ribs of the first embodiment are replaced with frame members 133 of circular cross section. Frame members 33 may alternately be of elliptical or hemicircular cross section, with the purpose of presenting a contoured area of contact for the wound light strand that minimizes bending, stretching, and crimping of the cord. Rear member 135 of frame portion 30 is still configured to rest against the rear face of drawer portion 40 when carrier portion 20 is slidably inserted, however, it is rectangularly configured without the flanges 36 of the first embodiment. A criss-cross frame 137 is used in place of the plurality of web ribs of the first embodiment.

The novel configuration of the present holiday light storage organizer 10 confers several apparent advantages over prior art solutions to the problem. The drawer configuration is a neat solution that is easily applied to a closet shelf, a garage shelf, or attic. When closed, the organizer 10 protects the light strands from light and dust. It is readily apparent to one of ordinary skill in the art of the present invention that the circumference of aperture 42 can be fitted with an ordinary pliant gasket or fitting to prevent the entry of air or moisture to the organizer. Furthermore, the ability of the present invention to have compact and stackable storage cases left behind is a chief advantage of the present invention over the prior art devices described herein. Sturdy and heavy storage cases 40 can remain on a closet shelf or in an attic or garage and need not be carried around during the application and storage of holiday light strands.

Having now fully set forth the preferred embodiments and certain modifications of the concept underlying the present invention, various other embodiments as well as certain variations and modifications thereto may obviously occur to those skilled in the art upon becoming familiar with the underlying concept. By way of example, face portion 22 of carrier portion 20 may be fitted with any of a number of prior art fittings for provision of a hasp through which a padlock may be applied, for secure storage of antique and other valuable articles. It is to be understood, therefore, that the invention may be practiced otherwise than as specifically set forth in the appended claims:

I claim:

1. A device for the storage of light strands comprising:

a drawer case formed as a walled enclosure and open at one end; and a carrier portion for insertion into said drawer case, said carrier portion further comprising, a front panel conforming to the open end of said walled enclosure;

a rear panel conforming to the open end of said walled enclosure and adapted to be slidably inserted into the walled enclosure;

a pair of elongate spaced frame members attached between said front panel and rear portion, said spaced frame members each having a cross-section defining a plurality of points of contact for a holiday light strand wound around said pair of spaced frame members to avoid crimping of said strand;

a strut attached between said elongate spaced frame members for reinforcement thereof; and a handle attached to said front panel.

2. The device for the storage of light strands according to claim 1, wherein the front panel of the carrier portion is formed with a central recess, and said handle is a pivoting handle set flush inside said recess.

3. The device for the storage of light strands according to claim 1, wherein the drawer case is formed as a walled enclosure having a top wall, bottom wall and opposing side walls, and open at one end.

4. The device for the storage of light strands according to claim 3, wherein one of said walls is defined by a small hole, and the front panel of said carrier portion comprises a protruding resilient tab for engaging said hole and thereby indexing said carrier portion inside said drawer case.

5. The device for the storage of light strands according to claim 1, wherein said elongate spaced frame members each further comprise an elongate flat member reinforced by an orthogonal rib, said elongate flat member defining two contact points and said rib serving to strengthens the flat member and also to provide a third point of contact for a holiday light strand or like article.

6. The device for the storage of light strands according to claim 1, wherein said elongate spaced frame members each further comprise a tubular member for contoured contact with a holiday light strand or like article.

7. The device for the storage of light strands according to claim 1, wherein said rear portion further comprises a plurality of radial flanges for engaging the inner surfaces of the drawer portion, and for preventing contents from sliding downward when carried.

8. The device for the storage of light strands according to claim 1, further comprising a clip formed on the inside of the front panel of the carrier portion for engaging one of the plug and socket portion of a strand.

9. The device for the storage of light strands according to claim 1, wherein said strut attached between said elongate spaced frame members further comprises a pair of spaced struts.

10. The device for the storage of light strands according to claim 1, wherein said strut attached between said elongate spaced frame members further comprises a pair of criss-cross struts integrally joined at the center.

11. A device for the storage of holiday light strands comprising:

a drawer case formed as a walled enclosure and open at one end, said drawer case formed as a walled enclosure having a top wall, bottom wall and opposing side walls, and open at one end, wherein one of said walls is defined by a small hole; and a carrier portion for insertion into said drawer case, said carrier portion further comprising, a front panel conforming to the open end of said walled enclosure, said front panel of said carrier portion comprises a protruding resilient tab for engaging said small hole and thereby indexing said carrier portion inside said drawer case;

a rear portion adapted to be slidably inserted into the walled enclosure;

a pair of elongate spaced frame members attached between said front panel and rear portion for receiving a wound holiday light strand or like article, a strut attached between said elongate spaced frame members for reinforcement thereof, and a handle attached to said front panel.

12. The device for the storage of holiday light strands according to claim 11, wherein said elongate spaced frame members each further comprise an elongate flat member reinforced by an orthogonal rib, said rib serving to strengthens the flat member and also to provide a further point of contact for a holiday light strand or like article.

* * * * *